US008893768B2

(12) United States Patent
Nooning et al.

(10) Patent No.: US 8,893,768 B2
(45) Date of Patent: Nov. 25, 2014

(54) METHOD OF CONTINUOUS CASTING THIN STEEL STRIP

(71) Applicant: Nucor Corporation, Charlotte, NC (US)

(72) Inventors: Robert Nooning, Zionsville, IN (US); Alan J. Deno, Jamestown, IN (US); Mark Schlichting, Crawfordsville, IN (US); Gary McQuillis, Blytheville, AR (US); Dhiren Panda, Armorel, AR (US); Neal Ross, Blytheville, AR (US); Leigh Woolley, Coniston (AU)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 13/680,795

(22) Filed: Nov. 19, 2012

(65) Prior Publication Data

US 2013/0126120 A1 May 23, 2013

Related U.S. Application Data

(60) Provisional application No. 61/652,292, filed on May 28, 2012, provisional application No. 61/560,959, filed on Nov. 17, 2011.

(51) Int. Cl.

| | |
|---|---|
| ***B22D 11/06*** | (2006.01) |
| ***B22D 11/16*** | (2006.01) |
| ***B22D 11/18*** | (2006.01) |

(52) U.S. Cl.

CPC ..... *B22D 11/0622* (2013.01); *B22D 11/16* (2013.01); *B22D 11/188* (2013.01)

USPC ..... 164/452; 164/480; 164/428

(58) Field of Classification Search

CPC ... B22D 11/0622; B22D 11/16; B22D 11/188

USPC ..... 164/452, 480, 428, 415, 475

See application file for complete search history.

(56) References Cited

U.S. PATENT DOCUMENTS

| | | | |
|---|---|---|---|
| 2,928,150 | A | 3/1960 | Kraay |
| 3,670,061 | A | 6/1972 | Nakayana et al. |

(Continued)

FOREIGN PATENT DOCUMENTS

| | | |
|---|---|---|
| AU | 9655871 | 1/1997 |
| EP | 0611138 | 8/1994 |

(Continued)

OTHER PUBLICATIONS

International Search Report for AU 2012903033, Mailed Sep. 28, 2012.

(Continued)

*Primary Examiner* — Kevin P Kerns

(74) *Attorney, Agent, or Firm* — Hahn, Loeser & Parks LLP; Lorraine Hernandez

(57) ABSTRACT

A method of continuously casting metal strip having the steps of assembling a pair of counter-rotatable casting rolls, assembling a metal delivery system adapted to deliver molten metal above the nip to form a casting pool, the casting pool forming a meniscus with each casting surface of the casting rolls, delivering a shell thickness controlling gas to select areas within 300 mm of end portions of at least one casting roll downwardly toward the meniscus between the casting pool and the casting surface adapted to control thickness of the metal shell, and control attenuation of the casting roll, and sensing the temperature and thickness profiles of the cast strip downstream from the nip to determine high or low temperature areas of the cast strip within 300 mm of the end portions and causing the gas to be delivered to the high or low temperature areas to change the thickness of the metal shell.

40 Claims, 9 Drawing Sheets
(1 of 9 Drawing Sheet(s) Filed in Color)

(56) References Cited

U.S. PATENT DOCUMENTS

| | | | |
|---|---|---|---|
| 3,703,391 | A | 11/1972 | Clishem et al. |
| 4,055,212 | A | 10/1977 | Vogel |
| 4,614,216 | A | 9/1986 | Savard et al. |
| 5,368,088 | A | 11/1994 | Furuya et al. |
| 5,590,701 | A | 1/1997 | Fukase |
| 5,787,967 | A | 8/1998 | Vendeville et al. |
| 5,799,523 | A | 9/1998 | Seidel et al. |
| 6,016,941 | A | 1/2000 | Damle |
| 6,273,178 | B1 | 8/2001 | Osada et al. |
| 6,739,383 | B1 | 5/2004 | Marchionni et al. |
| 7,156,151 | B2 | 1/2007 | Mahapatra et al. |
| 7,156,152 | B2 | 1/2007 | Hohenbichler |
| 7,328,737 | B2 | 2/2008 | Hohenbichler |
| 7,367,104 | B2 | 5/2008 | Hohenbichler et al. |
| 7,484,551 | B2 | 2/2009 | Blejde et al. |
| 2005/0236133 | A1 | 10/2005 | Kapaj et al. |
| 2007/0181284 | A1 | 8/2007 | Albrecht-Fruh et al. |
| 2008/0083525 | A1 | 4/2008 | Schlichting et al. |
| 2008/0264599 | A1 | 10/2008 | Blejde et al. |
| 2010/0132912 | A1 | 6/2010 | Mahapatra et al. |

FOREIGN PATENT DOCUMENTS

| | | |
|---|---|---|
| EP | 0706845 | 4/1996 |
| EP | 0750170 | 12/1996 |
| EP | 0760397 | 5/1997 |
| EP | 1521652 | 9/2007 |
| GB | 1354328 | 5/1974 |
| GB | 2334464 | 8/1999 |
| JP | 2003048044 | 2/2003 |
| JP | 2006312174 | 11/2006 |
| JP | 2011099318 | 4/2011 |
| WO | 9322087 | 11/1993 |
| WO | 2006064476 | 6/2006 |
| WO | 2006076771 | 7/2006 |
| WO | 2006092549 | 9/2006 |
| WO | 2009067735 | 6/2009 |

OTHER PUBLICATIONS

International Search Report for AU 2011905084, Mailed Jan. 19, 2012.

English Machine Translation of JP2006-312174, Sumitomo Metal Ind. Ltd., Published Nov. 16, 2006.

English Machine Translation of JP2003-048044, Nippon Steel Corp., Published Feb. 18, 2003.

Selines, R., "Selection of Stirring and Shrouding Gases for Steelmaking Applications", Copyright 1988, Union Carbide Corporation.

METHOD OF CONTINUOUS CASTING THIN STEEL STRIP

RELATED APPLICATIONS

This application claims priority to and the benefit of U.S. Provisional Patent Application No. 61/652,292 filed May 28, 2012, and U.S. Provisional Patent Application No. 61/560,959 filed Nov. 17, 2011, the disclosures of which are incorporated herein by reference.

BACKGROUND AND SUMMARY

This invention relates to the continuous casting of thin steel strip in a twin roll caster.

In a twin roll caster, molten metal is introduced between a pair of counter-rotated laterally positioned casting rolls forming a nip between them. The casting rolls are internally cooled so that metal shells solidify on the moving roll surfaces and are brought together at the nip between them to produce a thin strip product, delivered downwardly from the nip between the casting rolls. The term "nip" is used herein to refer to the general region at which the casting rolls are closest together. The molten metal may be received from a ladle through a metal delivery system comprising a tundish and a core nozzle located above the nip, to form a casting pool of molten metal supported on the casting surfaces of the rolls above the nip and extending along the length of the nip. The casting pool is usually confined between refractory side dams held in sliding engagement with the end surfaces of the casting rolls so as to restrict the two ends of the casting pool against outflow. The atmosphere in the casting area, or chamber, above the molten metal in the casting pool is usually controlled by delivering an inert gas such as argon or nitrogen to the area above the casting pool.

When casting steel strip in a twin roll caster, the thin cast strip leaves the nip at temperatures in the order of 1400° C. or above. An enclosure is provided beneath the casting rolls to receive the hot cast strip, through which the strip passes away from the strip caster in an atmosphere that inhibits oxidation of the strip. The oxidation inhibiting atmosphere may be created by delivering a non-oxidizing gas, for example, an inert gas such as argon or nitrogen, in the enclosure beneath the casting rolls. Alternatively, or additionally, the enclosure may be substantially sealed against ingress of an ambient oxygen-containing atmosphere during operation of the strip caster, and the oxygen content of the atmosphere within the enclosure may be reduced by oxidation of the strip to remove oxygen from the enclosure as disclosed in U.S. Pat. Nos. 5,762,126 and 5,960,855.

During operation, the metal flow rate and molten metal temperature are controlled to reduce the formation of solidified steel skulls in the casting pool in the area where the side dams, casting rolls and meniscus of the casting pool intersect, i.e. the "triple point" region. These unwanted solidified steel skulls, may form from time to time near the side dam and adjacent the end of the delivery nozzle, and can cause defects to the cast strip known as "snake eggs." When these skulls go through the roll nip, they may also cause the two solidifying shells at the casting roll nip to "swallow" additional liquid metal between the shells or may cause the strip to reheat and break disrupting the continuous production of coiled strip. The snake eggs defects may also be detected as visible bright bands across the width of the cast strip, as well as by spikes in the lateral force exerted on the casting rolls as they pass through the roll nip. Such resistive forces are exerted against the casting rolls in addition to the forces generated by the ferrostatic head in the casting pool. Additionally, skulls resulting in snake eggs in the cast strip passing through the nip between the casting rolls can cause lateral movement of the casting rolls and the side dams. To resist the increased forces generated, bias forces have also been applied to the side dams, increasing the force the side dams exert on the ends of the casting rolls, and, in turn, increasing side dam wear. There remains, therefore, a need to control the formation of unwanted solidified skulls in the casting pool and formation of snake eggs in the thin metal strip.

The thickness of the cast strip at any localized point across the width of the strip is dependent upon the thickness of the two solidifying shells on the opposing casting surfaces of the casting rolls, and the amount of liquid or mushy material that is passed through the nip between the two solidifying shells. An excess amount of liquid, or mushy, material between the shells will cause a localized expansion of the strip causing ridges to form in the strip surface. The amount of mushy that passes through the nip at any localized point across the width of the casting rolls is dependent upon the localized forces exerted on the forming strip at that point.

The force distribution across the casting rolls exerted on the strip is dependent on several factors. Such factors include: the cold profile of the casting rolls; the contour of the rolls due to bulk heat flux; the contour of the casting rolls due to heat flux distribution across the casting roll; and, the thickness of the solidifying shells at any point across the casting rolls. The cold profile of the casting rolls is the contour the casting rolls have before being placed in the continuous caster. Bulk heat flux refers to the rate of heat transfer from the molten metal pool into the casting rolls across the entire length of the casting rolls. The heat from the molten metal in the casting pool causes the outer portions near the casting surfaces of the casting rolls to expand forming a concave profile along the casting rolls.

To control this change in the casting roll profile during operation, the casting rolls have been generally formed having a concave profile smaller in circumference such that when the outer portions of the casting rolls heat and expand in operation the rolls have a desired contour. The two solidifying shells on the surface of the casting rolls coming together at the nip exert an outward force on the casting rolls as they pass through the nip. The force exerted by the shells on the casting rolls corresponds to the size of the shells passing through the nip and the amount of mushy or liquid material between the shells. There is, therefore, a need for a method of continuously casting metal strip which allows for the control of force distribution across the length of the casting rolls and the thickness of the cast strip, and in particular a method of controlling the force exerted upon the forming strip at localized points along the casting roll.

The concave casting roll comprises an outer sleeve, generally made of copper or copper alloy. Attenuation of the copper sleeve has been observed, where the temperature gradient of the casting rolls shows attenuation adjacent the end portions of the casting rolls. Tests demonstrate that the temperature profile of the crown in the surface of a casting roll over at least the last 150 mm from the end portions increases compared to the center portions. The end portion of the copper sleeve constrains the lateral expansion of the center portions of the copper sleeve in the axial direction of the casting roll and the observed attenuation in the copper sleeve end portions has the effect of increasing this constraint on the cylindrical tube of the casting roll, increasing diameters in the central section of the casting roll, and thus causing the casting roll to "belly out" or "crown up" more. This results in a corresponding decrease in the strip cross-sectional profile due to the increased roll crown. There is therefore, presently a need to locally affect this attenuation observed within 300 mm or 150 mm of the casting roll end portions.

Presently disclosed is a method of continuously casting metal strip that comprises the steps of assembling a pair of counter-rotatable casting rolls having casting surfaces laterally positioned to form a gap at a nip between casting rolls through which thin cast strip can be cast, assembling a metal delivery system adapted to deliver molten metal above the nip to form a casting pool supported on the casting surfaces of the casting rolls and confined at the ends of the casting rolls, the casting pool forming a meniscus with each casting surface of the casting rolls, and counter rotating the casting rolls to form metal shells on the casting surfaces of the casting rolls that are brought together at the nip to deliver cast strip downwardly from the nip. The method also includes delivering a shell thickness controlling gas to select areas within 300 mm of end portions of at least one casting roll downwardly toward the meniscus between the casting pool and the casting surface of the casting roll selected to control thickness of the metal shell, sensing the temperature and/or thickness profiles of the cast strip downstream from the nip to determine high or low temperature areas of the cast strip, or thick or thin strip thickness profile areas of the cast strip, within 300 mm of the end portions, and causing the gas to be delivered to the high or low temperature areas, or thick or thin strip thickness profile areas, to change the localized thickness of the metal shell.

Also disclosed is a method of continuously casting metal strip that comprises the steps of assembling a pair of counter-rotatable casting rolls having casting surfaces laterally positioned to form a gap at a nip between casting rolls through which thin cast strip can be cast, assembling a metal delivery system adapted to deliver molten metal above the nip to form a casting pool supported on the casting surfaces of the casting rolls and confined at the ends of the casting rolls the casting pool forming a meniscus with each casting surface of the casting rolls and counter rotating the casting rolls to form metal shells on the casting surfaces of the casting rolls that are brought together at the nip to deliver cast strip downwardly from the nip. The method further includes delivering a shell thickness controlling gas to select areas within 300 mm of end portions of at least one casting roll downwardly toward the meniscus between the casting pool and the casting surface of the casting roll adapted to control localized thickness of the cast strip.

In any embodiment of the method of continuously casting metal strip may comprise where the gas is delivered to the meniscus at a position between 30 mm and 50 mm from the end portions of the casting rolls. Further, or alternatively, the method may comprise where in addition determining high or low temperature areas of the cast strip within 50 mm, or within 150 mm, of the end portions and causing the gas to be delivered to such high or low temperature areas to change the thickness of the metal shell.

In other alternatives, the method of continuously casting metal strip may comprise where the gas is delivered to the meniscus from a distance less than 150 mm above the casting pool.

In further alternatives, the method of continuously casting metal strip may comprise where in addition the gas is delivered to the meniscus near the end portions of the casting roll, and, in still further alternatives, the gas is delivered to the meniscus at a second position between 50 mm and 300 mm from the end portions of the casting roll. In any alternative, the gas may be delivered to the meniscus at a first position within 50 mm from the end portions of the casting roll and a second position between 50 mm and 300 mm from the end portions of the casting roll.

The gas may be delivered to the meniscus of both casting rolls within 300 mm from the end portions of each casting roll.

In any alternative, the method of continuously casting metal strip may comprise where the shell thickness controlling gas is selected from the group consisting of argon, carbon dioxide, hydrogen, helium, nitrogen, air, dry air, water vapor, carbon monoxide and mixtures of thereof.

Further, the method may comprise assembling a carbon seal laterally positioned above each casting roll to restrict oxygen from entering the casting pool.

Various aspects of the invention will become apparent to those skilled in the art from the following detailed description, drawings, and claims.

BRIEF DESCRIPTION OF THE DRAWINGS

The patent or application file contains at least one drawing executed in color. Copies of this patent or patent application publication with color drawings will be provided by the Patent and Trademark Office upon request and payment of the necessary fee.

DETAILED DESCRIPTION OF THE DRAWINGS

Figure 1:
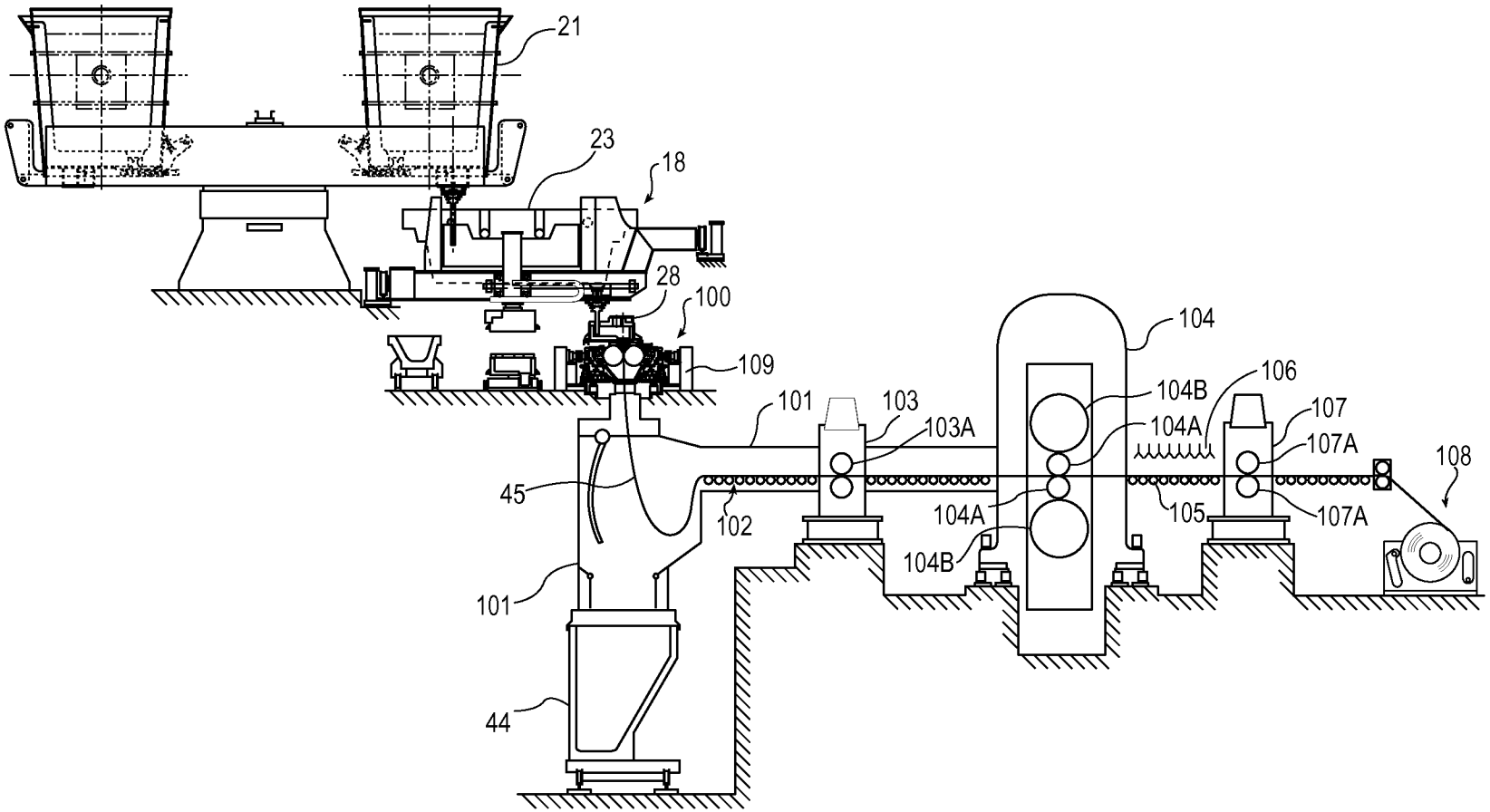
FIG. 1 is a diagrammatical side view of a twin roll caster of the present disclosure.
Figure 2:
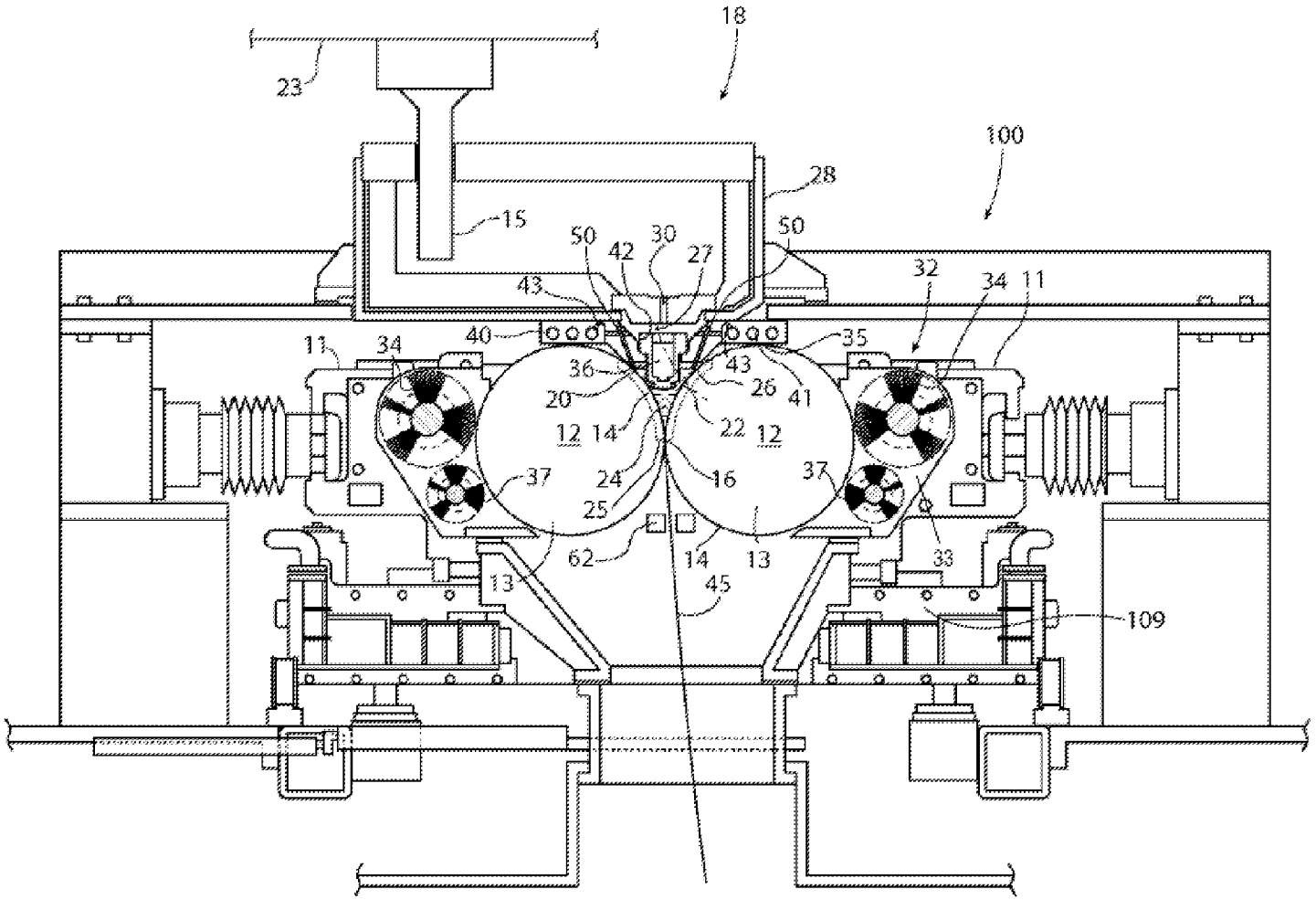
FIG. 2 is a partial cross-sectional view through a pair of casting rolls mounted in a continuous twin roll caster system.

Referring to FIGS. 1 and 2, a continuous strip steel casting apparatus and process is illustrated in a production line where steel strip can be produced. This production line includes a twin roll caster generally identified as 100 which produces as-cast steel strip 45 that passes into a sealed enclosure 101 and across a guide table 102 to a pinch roll stand 103 comprising pinch rolls 103A.

Upon exiting the pinch roll stand 103, the thin cast strip may pass through a hot rolling mill 104, where the cast strip is hot rolled to a customer, or market, specified thickness, and to improve the strip surface, and strip flatness. The hot rolling mill 104 comprises a pair of reduction rolls 104A and backup rolls 104B. The rolled strip then passes onto a run-out table 105 on which the strip may be force cooled by water jets 106 or spray mist or other suitable means, or also by convection and radiation. In any event, the rolled strip may then pass through a second pinch roll stand 107 comprising a pair of pinch rolls 107A, and then to a coiler 108.

Referring now to FIG. 2, a twin roll caster 100 comprises a main machine frame 109 supporting a pair of counter-rotatable casting rolls 12 having casting surfaces 14 laterally positioned to form a gap at a nip 16 between casting rolls 12 through which thin cast strip 45 can be cast. The casting rolls 12 may be mounted in a roll cassette 11 as described in U.S. patent application Ser. No. 12/050,987 filed Mar. 19, 2008. A metal delivery system, denoted generally as 18, is adapted to deliver molten metal above the nip 16 to form a casting pool 24 supported on the casting surfaces 14 of the casting rolls 12 and confined at the ends of the casting rolls 12 by side dams 25. Molten metal is supplied during a casting operation from a ladle 21 to a tundish 23, through a refractory shroud 27 to a distributor 28 and thence through a metal delivery nozzle, or core nozzle 20, positioned between the casting rolls 12 above the nip 16 and adapted to deliver molten metal via outlets 22 to the casting pool 24, supported on the casting surfaces 14 of the casting rolls 12 above the nip 16, a meniscus 26 forming where the surface of the casting pool 24 meets the casting roll surface 14. The casting rolls 12 are cooled and counter rotated to remove heat from the molten metal in the casting pool 24 to form metal shells on the casting surfaces 14 of the casting rolls 12. The metal shells are brought together at the nip 16, by the counter-rotating casting rolls 12, to deliver cast strip 45 downwardly from the nip 16.

Molten metal is introduced into the tundish 23 from the ladle 21 (see FIG. 1). The tundish 23 is fitted with an outlet passage adapted to selectively open and close to effectively control the flow of metal from the tundish 23 to the distributor 28 and through passageways 30 to the core nozzle 20. The distributor 28 may have one or more output passageways 30 running along the length of the core nozzle 20 to provide a more even distribution of molten metal into the core nozzle 20 and in turn into the casting pool 24. The core nozzles 20 are supported in the casting position by a core nozzle support plate 40. The core nozzle support plate 40 is positioned beneath the distributor 28 and has a central opening 42 to receive and support the core nozzle 20. The core nozzle 20 may be provided in two or more segments, and at least a portion of each core nozzle segment may be supported by the core nozzle plate 40.

The molten metal may flow from the delivery nozzle 20 through outlets 22 and into the casting pool 24 supported on the surfaces 14 of the casting rolls 12 above the nip 16. The upper surface 26 of the casting pool 24 (generally referred to as the "meniscus level") will generally rise above the lower end of the core nozzle 20 so that the lower end of the core nozzle 20, is submerged within the casting pool 24.

At the start of a casting operation, a short length of imperfect strip is typically produced as the casting conditions stabilize. After casting is started, the casting rolls 12 are moved apart slightly and then brought together again to cause the leading end of the strip to break away to form a clean lead end of the following cast strip 45 to start the casting campaign. The imperfect strip material is dropped into a scrap box receptacle 44 such as shown in FIG. 1, located beneath caster 100 forming part of the casting enclosure.

The casting rolls 12 may typically be about 500 mm in diameter, and may be up to 1200 mm or more in diameter. The length of the casting rolls 12 may be up to about 2000 mm, or longer, in order to enable production of strip product of up to about 2000 mm in width, or wider, as desired in order to produce strip product approximately the width of the rolls. Formed in each casting roll 12 is a series of cooling water passages (not shown) to supply water to cool the casting surfaces 14 of the casting rolls 12 so that metal shells solidify on the casting surfaces 14 as they move in contact with the casting pool 24. The casting surfaces 14 may be textured, for example, with a random distribution of discrete projections as described and claimed in U.S. Pat. No. 7,073,365.

As the casting rolls 12 are counter-rotated in contact with the casting pool, metal shells are formed on the casting surfaces 14 of the casting rolls 12 and are brought together at the nip 16 to produce from the metal shells, a solidified thin strip 45 cast downwardly from the nip 16. The thin cast strip 45 is passed into the sealed enclosure 101 and onto a guide table 102, which guides the strip 45 to pinch rolls 103A and 103B, through which it exits the sealed casting enclosure. The enclosure 101 may not be completely sealed, but appropriately sealed to allow control of the atmosphere within the enclosure so as to restrict ingress of oxygen within the enclosure. After exiting the sealed enclosure 101, the thin cast strip 45 may pass through additional sealed enclosures and pinch rolls to provide tension for the strip as it passes through in-line hot rolling 104 and cooling treatment 106 before coiling.

A pair of roll brush apparatus 32 are disposed adjacent the pair of casting rolls 12 such that they may be brought into contact with the casting surfaces 14 of the casting rolls 12 at opposite sides of nip 16 to clean the casting surfaces 14, with each revolution of the casting rolls 12, before the casting surfaces 14 come into contact with the molten metal in casting pool 24 at the meniscus 26. Each brush apparatus 32 may comprise a brush frame 33 which carries a main cleaning brush 34, adapted to cleaning the casting surfaces 14 of the casting rolls 12 during the casting campaign as described in U.S. Pat. No. 7,299,857. Optionally in addition, separate sweeper brushes 37 for cleaning the coarse material from the casting roll surfaces 14 at the beginning and end of the campaign may also be provided.

An enclosure 35 forming a casting area 36 above the casting pool 24 is bounded by the casting surfaces 14 of the casting rolls 12 above the nip 16, and the side dams 25. The enclosure 35 may include a pair of carbon seals (not shown), one positioned between the core nozzle support plate 40 and each casting roll 12 restricting ingress of ambient air into the casting area 36. Alternatively, in another embodiment, the casting area 36 may be bounded with gas curtains (not shown) to prevent the ingress of ambient air into the casting area 36. In any event, a gas mixture may be delivered into the casting area 36 forming a protective gas layer over the casting pool 24 between the casting surfaces 14 of the casting rolls 12. The gas mixture may be delivered along passageways 41 within the core nozzle support plate 40 through gas delivery ports 43 to the casting area 36, to one or both sides of the casting nozzle 20. The casting area 36 may be sealed or semi-sealed, restricting outside atmosphere gases from entering the casting area 36. As described in U.S. patent application Ser. No. 12/050,987, filed Mar. 19, 2008, the side dams 25 may be positioned with the core nozzle support plate 40 mounted on a roll cassette so as to extend horizontally above, and adjacent the ends of, the casting rolls 12, confining each end of the casting area 36 at the ends of the casting rolls 12.

It has been found that skulls (portions of solid metal) form in the casting pool 24 adjacent to the ends of the casting rolls 12 and apply resistive forces against the side dams 25. Skulls may form in the casting pool 24 along the side dam/casting roll interface in and adjacent a region known as the triple point. To resist the increased forces generated by the skulls, higher forces are applied to the side dams 25 against the casting rolls 12. These additional forces increase wear to the side dams, and, if severe, can cause strip break.

Figure 3:
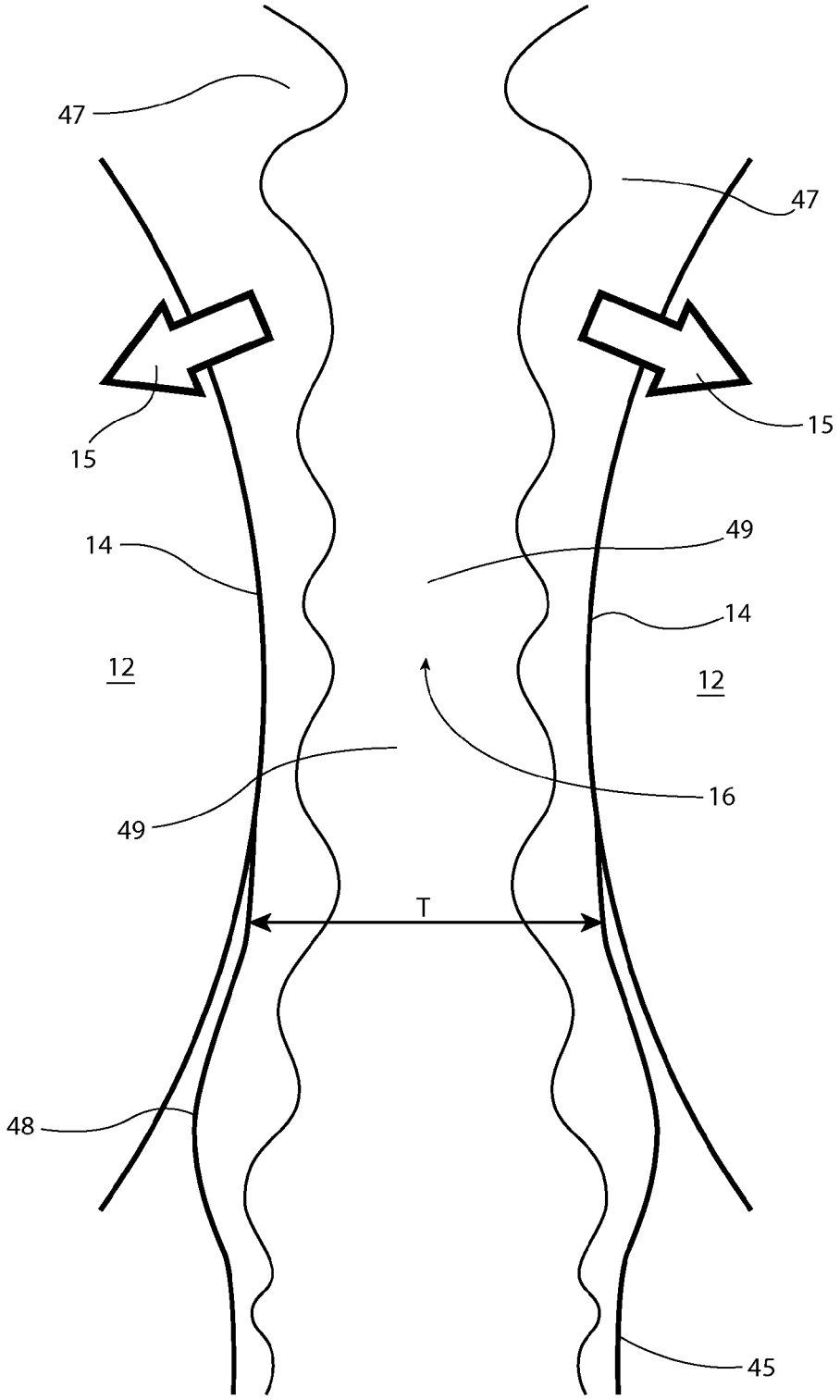
FIG. 3 is a magnified view of the nip portion of the continuous twin roll caster system shown in FIG. 1.

When casting steel strip in a twin roll caster, the molten metal in the casting pool will generally be at a temperature of the order of 1500° C. and above. Referring now to FIG. 3, heat flux 15 between the molten metal in the casting pool 24 and the casting surface 14 of the casting rolls 12 is the amount of heat removed from the solidify metal shells 47 through the casting rolls 12. The casting rolls 12 counter-rotate in contact with the casting pool bringing the shells 47 toward the nip 16 and forming cast strip 45 at the nip 16. The thickness T of the strip 45 at any point across the width of the cast strip 45 at the nip 16 includes the thickness of the two solidifying shells 47 (see FIG. 3) coming together at the nip and the amount of liquid or mushy material 49 that is passed through the nip 16 between the shells 47. An excess of mushy or liquid material 49 between the shells 47 downstream of the nip 16 may cause the shells 47 to expand outwardly forming ridges 48 on the cast strip 45. The amount of mushy or liquid material 49 between the shells 47 passing the nip 16 is also dependent in part upon the force exerted on the shells 47 by the casting rolls 12 and the shell thickness distribution across the strip width. The casting rolls 12 exert varying forces across the width of the strip depending on the surface contour of the casting rolls 12, the contour of the casting rolls 12 creating a force distribution across the width of the casting rolls 12 exerted on the strip 45.

As previously stated, the force distribution across the casting rolls 12 exerted on the strip 45 depends on several factors, including: the cold profile of the casting rolls 12; the contour of the rolls 12 due to total heat flux; the contour of the casting rolls 12 due to heat flux distribution across the casting roll 12; and, the thickness of the solidifying shells 47 at any point across the casting rolls 12. The two solidifying shells 47 on the casting roll surfaces 14 coming together at the nip 16 exert an outward force on the casting rolls 12 as they pass through the nip 16. The force exerted by the shells 47 on the casting rolls 12 correlates to the thickness of the shells 47 passing through the nip 16 and the amount of mushy or liquid material 49 between the shells 47. The ratio of the amount of mushy or liquid material 49 between the shells 47 and the amount of solidified shell 47 may be inferred from measurements of the strip thickness profile taken by strip sensors 62 positioned downstream of the nip.

Figure 4:
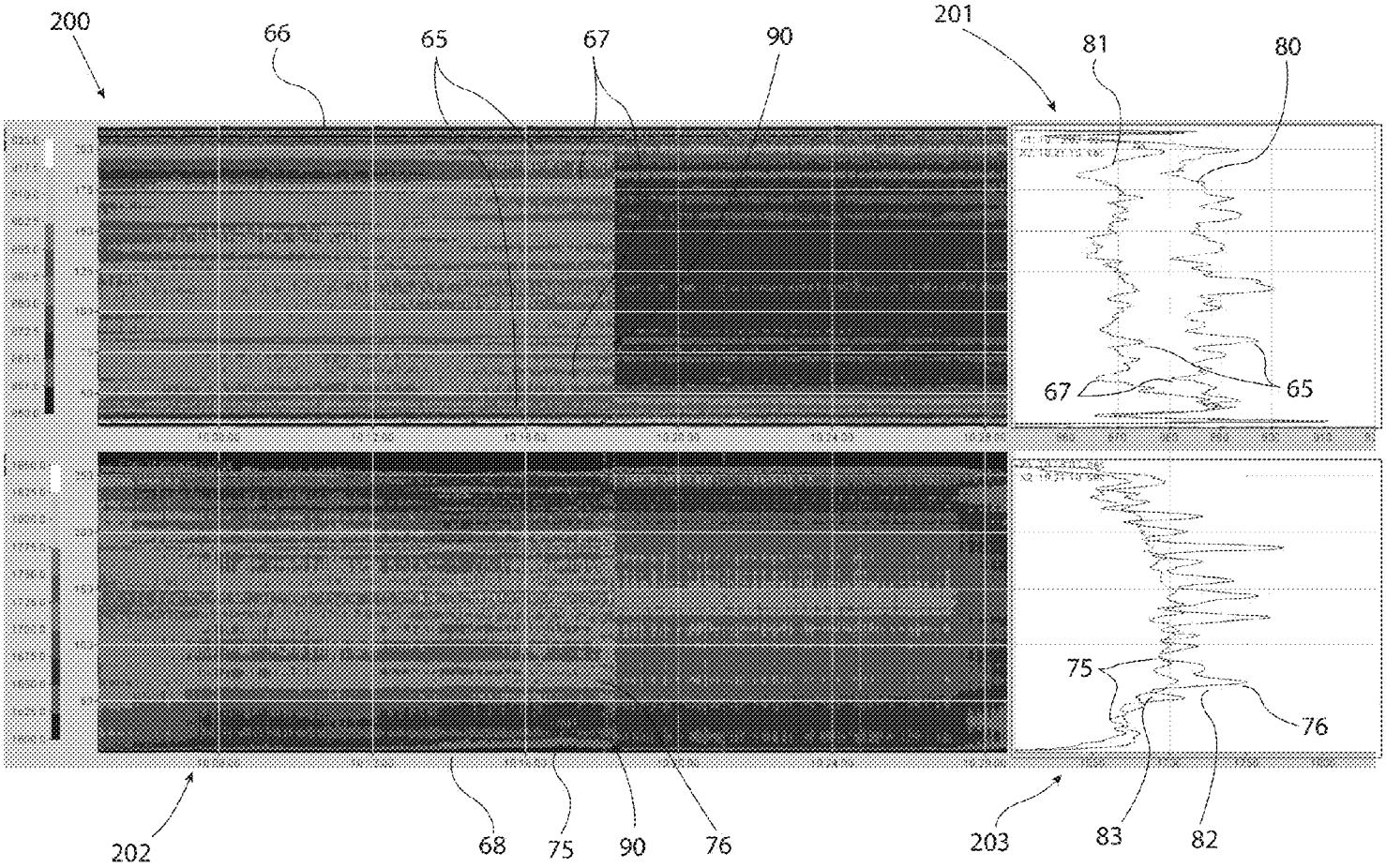
FIG. 4 illustrates graphs showing the strip temperature profile and strip thickness profile over time in an experiment.
Figure 5:
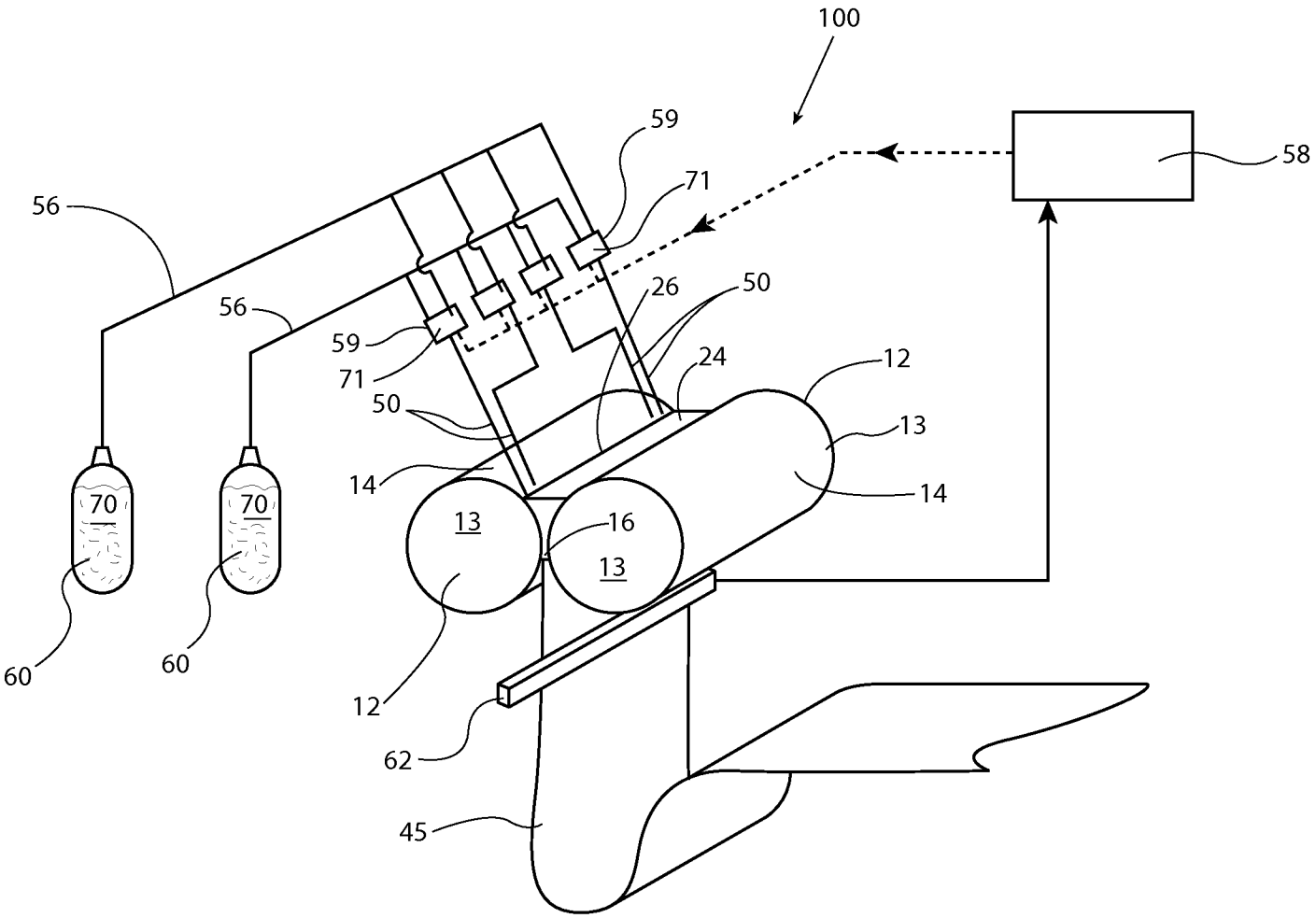
FIG. 5 is a partial perspective view of one embodiment of the presently disclosed continuous casting apparatus.
Figure 6:
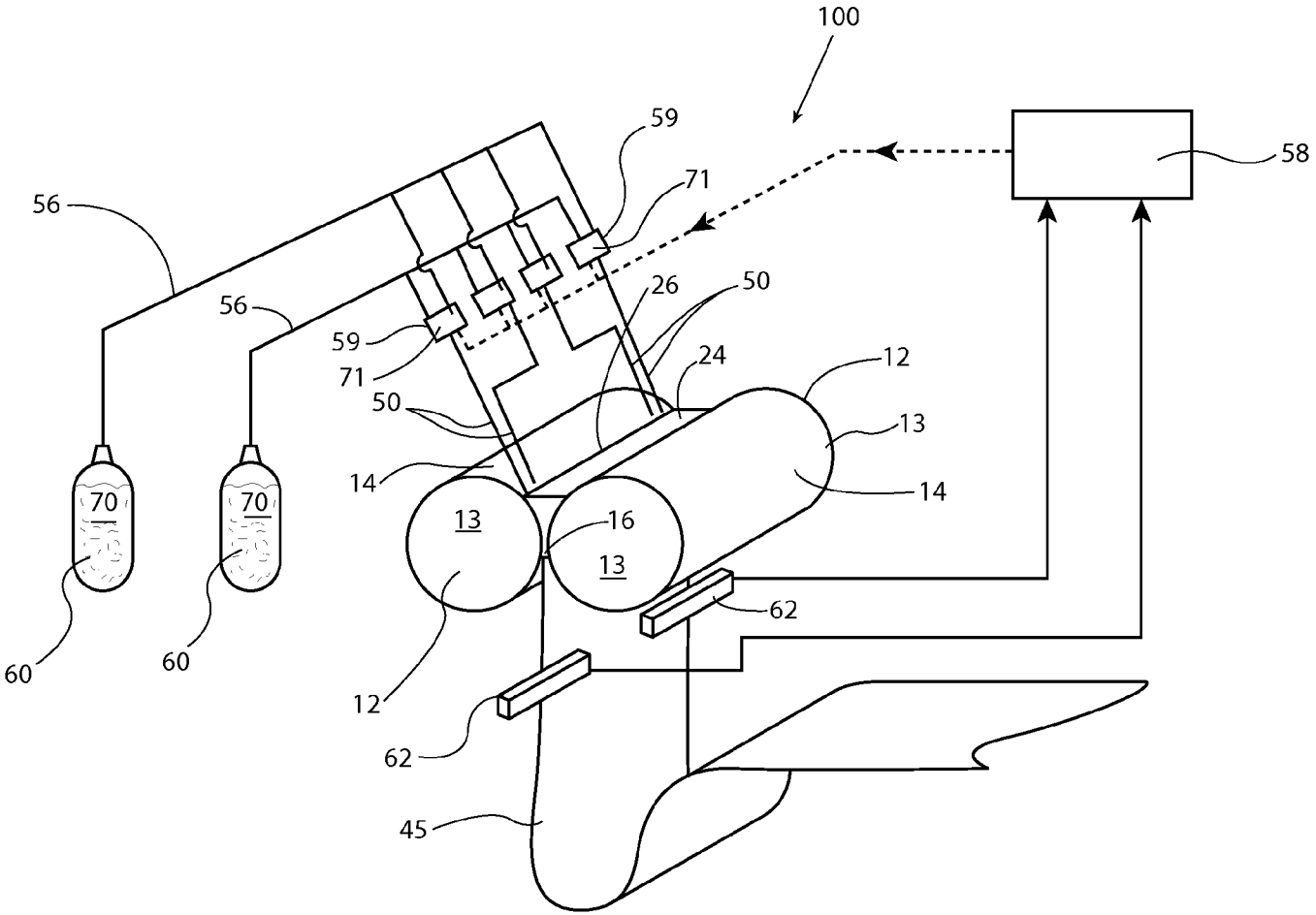
FIG. 6 is a partial perspective view of another embodiment of the presently disclosed continuous casting apparatus.

Referring to FIGS. 2, 5, and 6, the continuous casting apparatus 100 may include the sensor 62 for measuring temperature profile or thickness profile, or both, across the width of the cast strip 45 downstream of the nip 16. The sensor 62 may be a pyrometer to measure the thermal radiation profile of the strip 45 across the width of the strip 45, the sensor 62 adapted to produce a temperature profile 66 (as shown in FIG. 4) across the strip 45. Additionally, the sensor 62 may be adapted to produce an output signal corresponding to the temperature profile 66 of the strip 45 to form an input signal to a controller 58. Alternatively or in addition, the sensor 62 may include a strip thickness profile gauge adapted to measure the thickness contour across the cast strip 45 downward of the nip 16. In this case, the sensor 62, may be adapted to produce a strip thickness profile 68 (as shown in FIG. 4) and may be adapted to produce an output signal corresponding to the strip thickness profile 68 to form an input signal to a controller 58.

FIG. 4 includes four graphs showing data from sensors taken during a test where shell thickness controlling gas 71, in this case argon gas, was introduced within 300 mm of the casting roll end portions 13, according to an embodiment of the presently disclosed method.

Referring to the top graphs, Graph 200, the top left-hand graph, illustrates the temperature profile 66 across the width of the strip measured by a pyrometer downstream of the nip 16 over time. Graph 201, the top right-hand graph, illustrates the temperature profile across the strip at particular instances in time indicated by dashed lines running vertically across graph 200. Temperature profile 80 illustrates the temperature profile across the strip prior to the introduction of the argon gas at a time 90, and temperature profile 81 illustrates the temperature profile across the strip after the introduction of the argon gas at a time 90.

Referring to the bottom graphs, Graph 202, the bottom left-hand graph, illustrates the strip thickness profile 68 across the width of the strip over time. Graph 203, the bottom right-hand graph, illustrates the strip thickness profile across the strip at particular instances in time, indicated by dashed lines running across the graph 202. Strip thickness profile 82 illustrates the strip thickness profile across the strip prior to the introduction of argon gas at a time 90, and strip thickness profile 83 illustrates the strip thickness profile across the strip after the introduction of argon gas.

During the test, at a time 90, argon gas was selectively introduced downwardly toward the meniscus within 300 mm of end portions of the casting rolls from position within 150 mm above the meniscus 26. The argon gas was introduced at localized high temperature areas and/or high thickness areas within the select distance of the casting roll end portions 13 indicated by high temperature and/or high thickness regions on the cast strip 45 as measured by the pyrometer and/or strip thickness profile detector, downstream of the nip 16. The locations of introduction of shell thickness controlling gas 71 may be selected by observing high or low localized temperature areas and/or thick or thin cast strip profile areas via sensors 62. With the detection of localized high or low temperature regions and/or thick or thin strip profile areas, shell thickness controlling gas 71 is to be delivered, the selection of the amount and composition of the gas 71, and the delivery of the gas 71 are all controlled by a controller 58 (see FIGS. 6-10).

We have found that localized high force distributions, i.e. areas where the shells 47 (see FIG. 3) are squeezed together with greater force, may inhibit the squeezing of the shells 47 together at other areas across the casting rolls 12, especially central areas. Localized high force distributions indicate shells passing through the nip with little or no mushy material between them. Mushy passing through the nip between shells radiates heat, therefore, localized high force distributions may be determined by measuring cold spots 67 across the width of the strip 45, obtained from the temperature profile 66 determined by the sensor or sensors 62 (such as a pyrometer or other temperature sensor). Such areas are also associated with thin thickness areas on the strip, identified by reference numbers 75 in FIG. 4. Similarly, the localized low force distributions are where the shells 47 are inhibited from being squeezed together by the localized high force distributions in other areas across the width of the shell, and therefore having more mushy material pass through the nip between the shells at such low force areas evidenced by high localized temperature identified by reference numbers 65 in FIG. 4, measured across the width of the strip 45 as the temperature profile 66 with the sensors 62. Such high temperature areas are associated with thick strip profile areas of the cast strip, identified by reference numbers 76 in FIG. 4, as detected by a profile detector, the measurements of which are illustrated in the bottom graphs of FIG. 4. Localized high force distributions also tend to occur at or within a distance 150 or 300 mm of the end portions 13 of the casting rolls 12. The localized high and low force distributions across the width of the casting rolls 12 tends to create ridges and troughs in the surface of the strip 45. If the ridges and troughs are too excessive, it is not possible to effectively reduce or eliminate these ridges during hot or cold rolling the strip 45 to the customer specifications, and the strip 45 has to be discarded or recycled. A cast strip 45 having a strip profile 68 requiring minimal rolling to reduce or eliminate these ridges is desirable.

Heat flux is the rate at which heat is removed from the molten metal in the casting pool 24 into the casting rolls 12. For a given thickness of strip passing through the nip 16 and for a given casting roll speed, increased heat flux between the molten metal and the casting rolls 12, provides increased cooling of the solidifying shells 47 on the casting roll surfaces 14, and increases the thickness of the shells 47. Similarly, decreased heat flux between the molten metal and the casting rolls 12, provides decreased cooling of the solidifying shells 47 on the casting roll surfaces 14. The heat flux, and therefore the thickness of the shells 47 forming on the casting roll surfaces 14, may be affected by varying the composition of the gas above the casting pool 24 near the meniscus 26. For example, carbon dioxide gas, humidified air, or hydrogen have been found to increase and provide for control of the heat flux between the molten metal and the casting roll surfaces 14. Conversely, argon gas has been found to decrease the heat flux between the molten metal and the casting roll surfaces 14 and provide for control of the heat flux.

As previously explained, the localized high and low force distributions across the width of the casting rolls 12 may be evidenced by localized cold and hot temperature areas, on the temperature profile 66 of the casting rolls 12, and thin and thick areas, respectively, on the thickness profile 68 of the cast strip 45. Previously, changing the composition of the entire volume of gas in the casting area 36 above the casting pool 24 would affect the heat flux across the entire length of the casting rolls 12 maintaining the ridges and troughs on the surface of the strip 45. However, to affect the heat flux at localized areas along the casting roll 12 and even out the ridges and the troughs it is necessary to deliver a shell thickness controlling gas 71 to selected areas of the casting rolls 12 delivered downwardly toward the meniscus 26 between the casting pool 24 and the casting roll surfaces 14. The shell thickness controlling gas 71 may be adapted to control the increase or decrease of the thickness of the metal shell 47 as desired. For example, the selected shell thickness controlling gas 71 may be delivered locally to end portions 13 of the casting rolls 12 toward the meniscus 26 between the casting pool 24 and the casting roll surfaces 14.

The graphs in FIG. 4 illustrate the effect of introducing argon gas within 300 mm of the casting roll end portions 13. Argon gas decreases the heat flux between the molten metal and the casting roll surface 14, and was selectively introduced at localized low temperature areas and/or low thickness profile areas along the casting roll end portions 13 (see FIG. 6), the low temperature areas having been detected by the nip pyrometer, or the low thickness profile areas having been detected by the strip thickness profile gauge. Referring to FIG. 4, the localized temperature profile 80 of graph 201, taken prior to the introduction of argon gas, at time 90, illustrates greater fluctuations in the temperature across the width of the strip compared to the temperature profile 81, taken after the introduction of argon gas. The simultaneously measured thickness profile 82 of graph 203, taken prior to the delivery of argon gas, at time 90, illustrates greater fluctuations in the strip thickness profile 83 compared to the second thickness profile 83, taken after delivery of the argon gas. The strip temperature profile 80 taken prior to the introduction of argon gas within a specified distance of casting roll end portions 13, shows more fluctuation in temperature across the width of the cast strip 45 compared with the strip temperature profile 81 taken after to the introduction of argon gas. Also, the strip thickness profile 82 taken prior to the introduction of argon gas, shows more fluctuations than the strip thickness profile 83 taken after to the introduction of argon gas. This measurement shows that after the introduction of argon gas, in accordance with the presently disclosed methods, the strip 45 was more uniform than before the introduction of argon gas. A more uniform strip profile requires less downstream processing to prepare the strip to meet customer specifications, making for a more efficient and cost-effective casting of strip. The shell thickness controlling gas, such as argon gas, may be introduced downwardly toward the meniscus within a specified distance of the casting roll end portions 13. The specified distance of end portions 13 at a time 90 may be within 300 mm, 150 mm 50 mm, or 35 mm, from the end of casting roll as discussed in previously described embodiments.

Also, the experiment confirms that the heat flux was reduced and controlled by the introduction of argon gas, at the localized low strip temperature areas, and/or low strip thickness profile areas, within 300 mm of the casting roll end portions 13. Hot spots 65 in the temperature profile, in both tests, illustrated in graph 200, of FIG. 4, are reduced in both size and number after the introduction of argon gas. Observing graph 201, it can be seen that the temperature profile 80, measured prior to the introduction of argon gas to selected localized low strip temperature areas, and/or low strip thickness profile areas, within 300 mm of the casting roll end portions 13, has a greater average temperature than the temperature profile 81 measured after the selective introduction of argon gas. Prior to the introduction of argon gas, the thin strip areas 75 adjacent end portions of the casting rolls shown in graph 202, indicates that the casting roll end portions 13 were close together and were unevenly squeezing the strip 45 at the nip 16 with more force, compared to center regions along the casting roll surface 14. After the argon gas was introduced adjacent the casting roll end portions 13, at a time 90, the thickness of the cast strip 45 adjacent the end portions of the casting rolls 12 increased, indicating that there was a decrease of the gap between the casting rolls surfaces 14. These results demonstrate that the introduction of shell thickness controlling gas 71 at localized low strip temperature areas regions within a specified distance of the casting roll end portions 13, produces a more uniform strip profile across the entire width of the strip 45. Controlling the localized heat flux distributions by directing shell thickness controlling gas 71 to the casting roll surface at selected localized high or low temperature areas, and/or high or low strip profile thickness areas, within 300 mm of the casting roll end portions 13 allows control of the heat flux distribution across the entire length of the casting rolls 12 and therefore control of strip profile across the strip width.

As previously stated, the force distribution across the casting rolls 12 is also affected by the localized attenuation of the casting rolls 12 adjacent the end portions 13. The concave casting roll 12, usually comprises a copper sleeve. The portions of the copper sleeve within 300 mm of the casting roll end portions 13 constrain the center portions of the copper sleeve as it expands with heat, causing an increase in the diameter of the casting roll 12 and reducing the thickness profile of the cast strip 45. It has been found that affecting the localized heat flux by selectively introducing shell thickness controlling gas toward the meniscus, within 300 mm of the casting roll end portions 13, affects the attenuation of the casting roll end portions. Selectively introducing a shell thickness reducing gas adjacent the casting roll end portions 13 will cause those areas of the casting rolls 12 to cool, lowering the attenuation of the copper sleeve adjacent the casting roll ends portions 13. This, in turn, reduces the constraint imposed by the ends of the copper sleeve on the center portions, reducing the diameter of the casting rolls 12 and increasing the strip thickness profile. On the other hand, introducing a shell thickness increasing gas adjacent the casting roll end portions 13, will cause the portions of the casting rolls 12 to heat, increasing the attenuation of the copper sleeve adjacent the casting roll end portions 13. This, in turn, increases the constraint imposed by the ends of the copper sleeve on the center portions, increasing the diameter of the casting rolls 12, and reducing the strip thickness profile.

FIGS. 5 through 9 illustrate various embodiments of continuous casting apparatuses adapted to selectively deliver shell thickness controlling gas within 300 mm of edge portions of the casting rolls. Referring to FIG. 5, the continuous casting apparatus 100 comprises a gas delivery pipe 50 within 300 mm of the end portions 13 of the casting rolls 12, adapted to direct shell thickness controlling gas 71 downwardly toward the meniscus 26 between the casting pool 24 and the casting surfaces 14 of the casting rolls 12, the shell thickness controlling gas 71 adapted to change the thickness of the metal shell. Controlling gas 71 may be delivered from a position within 150 mm above the meniscus 26. The continuous twin roll caster 100 may include gas delivery pipes 50 at multiple locations along the width of the casting rolls 12 to locally control the thickness of the shells solidifying on the casting surfaces 14. The continuous casting apparatus 100 may also include at least one sensor 62, such as a pyrometer and/or a strip profile thickness detector, adapted to measure certain properties of the cast strip 45 or the casting rolls 12, such as the strip temperature profile of the strip thickness profile. Additionally, the sensor 62 may be adapted to provide an output signal input to a controller 58. The sensor 62 may be positioned adjacent and downwardly from the nip 16, able to take measurements and obtain, for example, the temperature profile and/or contour thickness profile of the strip 45, immediately after passing through the nip 16. Alternatively, or in addition, the sensor or sensors 62 may be positioned at a location downstream from the nip 16 and adapted to measure parameters of the cast strip 45. The controller 58 may be adapted to receive the output signals from the sensor, or sensors, 62, and may also be adapted to identify the high or low localized low strip temperature areas and/or low strip thickness profile areas, and also select locations on the casting roll surface 14, downwardly toward the meniscus 26, for delivery of shell thickness controlling gas 71, and also adapted to determine the composition and amount of shell thickness controlling gas to be applied to each selected location. The controller 58 may determine the desired amount of shell thickness controlling source gases 70 to be directed from each shell thickness controlling gas source 60 to each mixer 59 for delivery of a desired amount of mixed shell thickness controlling gas 71 of a desired composition downwardly toward the meniscus 26 between the casting pool 24 and the casting surface 14 of the casting roll 12, through gas delivery pipes 50 positioned above the selected localized area of the meniscus 26.

As shown in FIGS. 5 and 6, a plurality of gas delivery pipes 50 may be positioned within a specified distance of each end portion 13 and each controlled to direct a desired shell thickness controlling gas 71 from the mixers 59 downwardly toward the meniscus 26 between the casting pool 24 and the casting roll surface 14 as desired. In some embodiments the gas delivery pipes 50 may be selectively positioned over areas of the meniscus 26 within a specified distance of the casting roll end portions 13 where localized high or low strip temperature areas and/or thick or thin strip profile areas are most likely to occur and be detected. In other embodiments, the positioning of the gas delivery pipes 50 may be controlled by the controller 58, the controller 58 are connected to actuators (not shown) to cause the gas delivery pipes 50 to move to a position over localized high or low strip temperature areas, and/or thick or thin strip profile areas along the casting rolls 12 within a specified distance of the end portions 13. In any embodiment, the gas delivery system 95 may be configured to deliver selected amounts and compositions of shell thickness controlling gas 71 to each gas delivery pipe 50 individually, to groups of gas pipes 50, or both.

To provide for different desired compositions of shell thickness controlling gas 71, multiple shell thickness controlling gas sources 60, may be provided. Each source 60 may be a container, such as a cylinder, containing a desired shell thickness controlling source gas 70. Alternatively, the source may be an external source. There may be any number of source gases 70 and accompanying gas sources 60. Shell thickness controlling gas 71 adapted to reduce heat flux may be any gas that can reduce heat flux, such as argon gas, nitrogen gas, or a mixture thereof. Alternatively or in addition, shell thickness controlling gas 71 adapted to increase heat flux may be any gas or mixture of gases that can increase heat flux, such as carbon dioxide gas, humidified air, or hydrogen.

Continuing to refer to FIGS. 5 and 6, a method of continuously casting metal strip 45 may comprise assembling a pair of counter-rotatable casting rolls 12 having casting surfaces 14 laterally positioned to form a gap at a nip 16 between casting rolls 12 through which thin cast strip 45 can be cast. The method also includes assembling a metal delivery system 18 (see FIGS. 1 and 2) adapted to deliver molten metal above the nip 16 to form a casting pool 24 supported, on the casting surfaces 14 of the casting rolls 12 and confined at the end portion 13 of the casting rolls 12 the casting pool 24 forming a meniscus 26 with each casting surface 14 of the casting rolls 12 and counter rotating the casting rolls 12 to form metal shells on the casting surfaces 14 of the casting rolls 12 that are brought together at the nip 16 to deliver cast strip 45 downwardly from the nip 16. Then, delivering a shell thickness controlling gas 71 to select areas within 300 mm of end portions 13 of at least one casting roll 12 downwardly toward the meniscus 26 between the casting pool 24 and the casting surface 14 of the casting roll 12 adapted to control thickness of the metal shell, and sensing either or both the temperature profile 66 and the thickness profile 68 of the cast strip 45 downstream from the nip 16 to determine high or low temperature areas of the cast strip 45 and thin or thick areas of the cast strip 45 within 300 mm of the end portions 13. Other embodiments may include the step of delivering a shell thickness controlling gas 71 to select areas within 150, 50 or 35 mm of end portions 13 of at least one casting roll 12 downwardly toward the meniscus 26 between the casting pool 24 and the casting surface 14 of the casting roll 12 adapted to control thickness of the metal shell, and sensing the temperature profile 66 and/or the thickness profile 68 of the cast strip 45 downstream from the nip 16 to determine high or low temperature areas of the cast strip 45 and thin or thick areas of the cast strip 45 within 150, 50 or 35 mm of the end and/or portions 13 and causing the gas 70 to be delivered to such high or low temperature areas to change the thickness of the metal shell.

In other embodiments the temperature profile 66 and/or strip thickness profile 68 may not be measured. In such embodiments, the presently disclosed method may include assembling a pair of counter-rotatable casting rolls 12 having casting surfaces 14 laterally positioned to form a gap at a nip 16 between casting rolls 12 through which thin cast strip 45 can be cast. The method includes the step of assembling a metal delivery system 18 (see FIGS. 1 and 2) adapted to deliver molten metal above the nip 16 to form a casting pool 24 supported on the casting surfaces 14 of the casting rolls 12 and confined at the end portions of the casting rolls 12, the casting pool 24 forming a meniscus 26 with each casting surface 14 of the casting rolls 12, and counter rotating the casting rolls 12 to form metal shells on the casting surfaces 14 of the casting rolls 12 that are brought together at the nip 16 to deliver cast strip downwardly from the nip 16, The method includes the step of delivering shell thickness controlling gas 71 to select areas within 300, 150, 50, or 35 mm of end portions 13 of at least one casting roll 12 downwardly toward the meniscus 26 between the casting pool 24 and the casting surface 14 of the casting roll 12 adapted to control thickness of the metal shell. The continuous casting apparatus 100 may also include a controller 58 adapted to control the delivery of selective amounts of shell thickness controlling source gas 70 to mixers 59 with each mixer associated with at least one gas delivery pipe 50 adapted to deliver mixed shell thickness controlling gas 71 downwardly toward the meniscus 26 at a localized position along the casting roll 12 within a selected distance from the end portions 13 of the casting rolls. The amount and composition of shell thickness controlling gas 71 may be selectively determined based on a desired strip contour profile. In alternative embodiments, the shell thickness controlling gas 71 delivered downwardly toward the meniscus 26 may be obtained directly from the shell thickness controlling gas source 60.

As shown in FIGS. 5 and 6, some embodiments of the method may include the step of additionally determining such high or low temperature areas of the cast strip 45 within 150 mm of the end portions 13 and causing the gas 71 to be delivered to such high or low temperature areas to change the thickness of the metal shell. Alternatively, the method may comprise the step of where in addition determining such high or low temperature areas of the cast strip 45 within 50 mm or 35 mm of the end portions 13 and causing the gas 71 to be delivered to such high or low temperature areas to change the thickness of the metal shell. In other embodiments, the gas 71 is delivered to the meniscus 26 at a position between 30 and 50 mm from the end portions 13 of the casting rolls 12. In further embodiments, as shown in FIG. 6, the high or low temperature areas of the cast strip 45 are detected within 150 mm of the end portions 13 of the casting rolls 12 with localized sensors 62. Such sensors may be a pyrometer or a strip profile thickness detector, or both downstream of the nip. In embodiments, as can be seen in FIG. 2, the method of continuously casting metal strip 45 may additionally comprise delivering the gas 70 to the meniscus 26 within a distance less than 150 mm above the casting pool 24.

Figure 7:
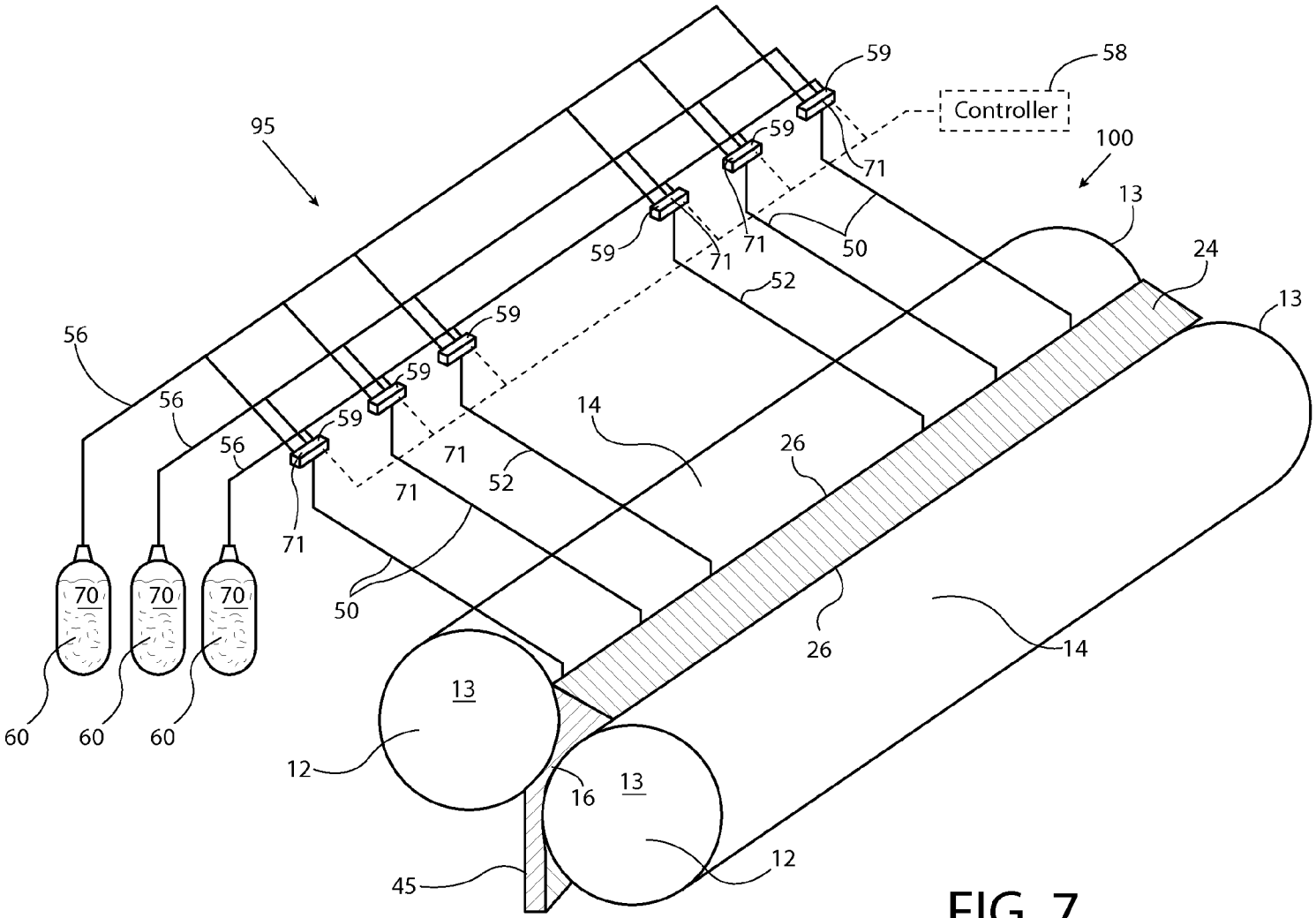
FIG. 7 is an enlarged partial perspective view of another embodiment of the presently disclosed continuous casting apparatus shown in FIG. 6.
Figure 9:
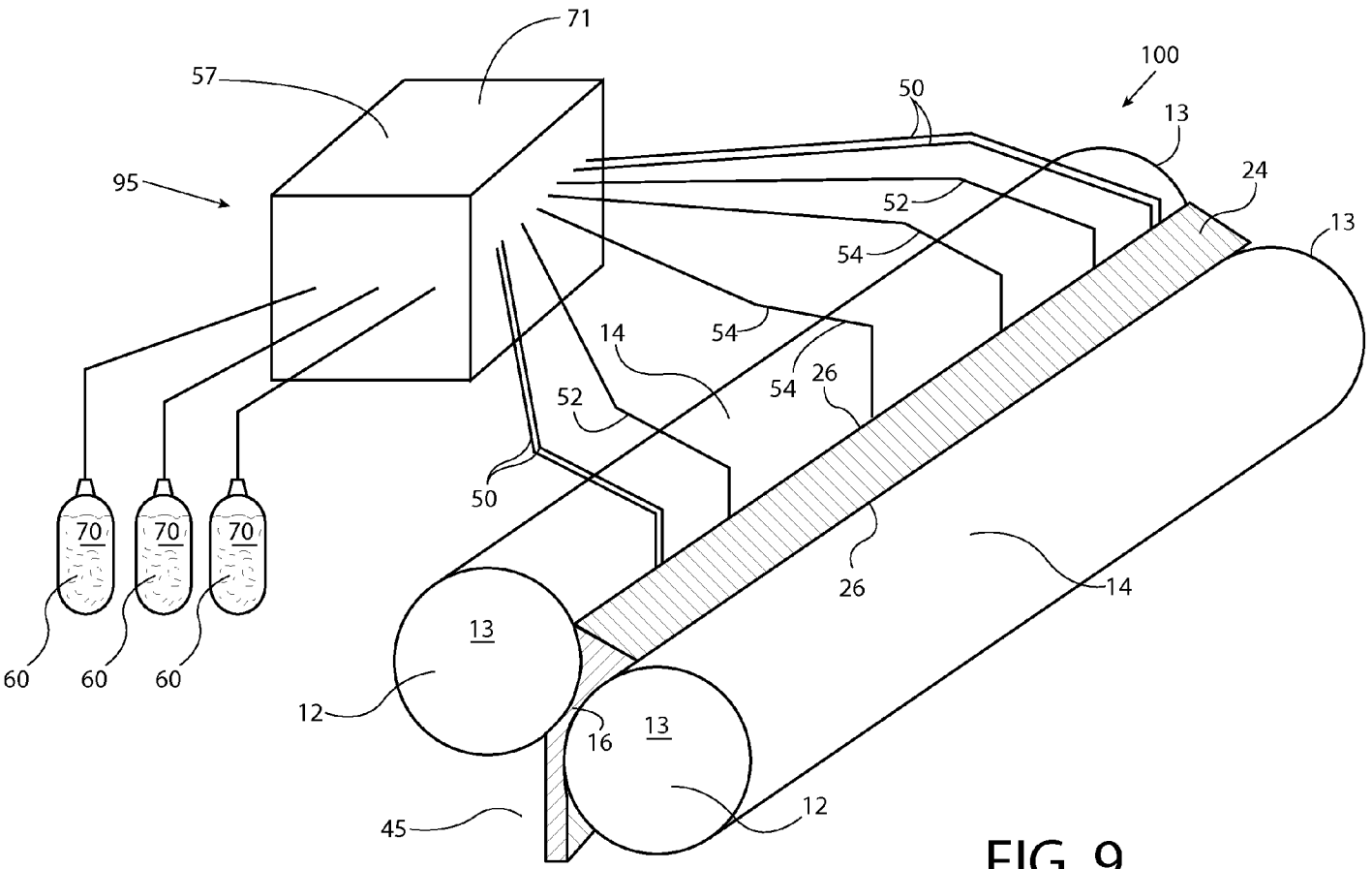
FIG. 9 is an enlarged partial perspective view of another embodiment of the presently disclosed continuous casting apparatus shown in FIG. 6.

The method may also comprise where in addition the gas 71 is delivered to the meniscus 26 near the end portions 13 of the casting roll 12. The continuous casting apparatus 100 may comprise two adjacent edge gas delivery pipes 50 adjacent each casting roll end portion 13, as shown in FIGS. 5, 7, and 9, or the continuous casting apparatus 100 may comprise a single gas delivery pipe 50 adjacent each casting roll edge portion 13. In one embodiment, the continuous casting apparatus 100 may comprise two edge gas delivery pipes 50 as shown adjacent each end portion 13 of both casting rolls 12. Each gas delivery pipe may be connected to at least one mixer 59 adapted to receive at least one shell thickness controlling source gas 70 from at least one gas source 60, mix, and deliver the gas mixture 71 downwardly toward the meniscus 26 between the casting pool 24 and the casting roll surface 14 through selected gas delivery pipes 50. The controller 58 is adapted to receive input from the at least one strip sensor 62 and determine the desired location of gas delivery through selected gas delivery pipes 50 within a selected distance of end portions 13 and compute the desired amount of each source gas 70 to be delivered to each mixer 59, the mixed shell thickness controlling gas 71 delivered through the selected gas delivery pipes 50 downwardly toward the meniscus 26 between the casting roll surface 14 and the casting pool 24. The controller 58 is also adapted to cause the desired amount of each source gas 70 to be delivered to each mixer 59 as desired along gas transport pipes 56, the mixer adapted to mix each source gas 70 and deliver the mixed shell thickness controlling gas 71 to gas pipes 50 disposed above the meniscus 26 of the casting pool 24, at the desired position along the casting rolls 12 within a selected distance of the end portion 13. The controller 58 may be adapted to control the amount of shell thickness controlling source gas 70 into each mixer 59 individually, such that the source gas 70 may be delivered to each mixer 59 in amounts corresponding to the desired effect on the shells found by the casting surfaces 14 at a position below the gas delivery pipe 50 associated with the individual mixer 59. Alternatively, the controller 58 may be adapted to control the amount of shell thickness controlling gas 70 into some, or all, mixers 59 at the same time in amounts correlating to the desired amounts of each individual source gas 70 required to produce the desired effect.

The embodiment illustrated in FIG. 7 is similar to the embodiments shown in FIGS. 5 and 6, but in addition the gas is delivered to the meniscus 26 at a first position 50 within 50 mm from the end portions 13 of the casting roll 12 and a second position 52 between 50 and 300 mm from the end portions 13 of the casting roll 12. Again, controlling gas 71 may be delivered from a position within 150 mm above the meniscus 26. The continuous casting apparatus 100 may include a gas delivery system 95 having gas delivery pipes 50 adapted to deliver shell thickness controlling gas 71 downwardly toward the meniscus 26 of the casting pool 24 adjacent the casting roll surface 14 of one or more casting rolls 12 within a selected distance of the end portion 13 of the casting roll. Gas delivery pipes 50 may be disposed at a first position within 50 mm of the casting roll end portions 13, additional delivery pipes 52 may be disposed at a second position inwardly from the first position, between 50 and 300 mm of the casting roll end portions 13. Each gas delivery pipe 50, 52 may be adapted to deliver shell thickness controlling gas 71 downwardly toward the meniscus 26 to effect the localized heat flux on the casting surface 14 below each gas delivery pipe 50, 52. Optionally, sensors 62 may be positioned downwardly of the nip 16 to measure properties of the cast strip 45. Such properties may include the temperature profile 66 or the thickness profile 68 of the cast strip 45, as shown in FIG. 4. The sensor, or sensors, 62 (see FIGS. 5 and 6) may adapted to output data to a controller 58, the controller adapted to receive the data from the sensor, or sensors, 62 and selectively determine the desired amount and composition of shell thickness controlling gas 71 to be delivered downwardly toward the meniscus 26 at selected locations within the selected distance of the end portion 13. The selected locations corresponding to localized high or low strip temperature areas and/or thick or thin strip profile areas, as indicated by hot and cold areas on the cast strip temperature profile 66, or thick or thin areas on the strip thickness profile 68, respectively. The controller 58 also is adapted to cause a desired amount of each shell thickness controlling source gas 70 from each gas source 60, such as a container or source gas producing unit, to be delivered to each mixer 59 for delivery downwardly toward the meniscus 26 via gas delivery pipes 50. The controller 58 may be adapted to selectively control the delivery of each supply gas to each mixer 59 individually. Alternatively, the controller 58 may be adapted to selectively control the delivery of each supply gas to all, or some, mixers 59 collectively. In other embodiments the controller 58 may be configured to control the location of the gas delivery pipes 50, 52 such that the controller 58 is capable of moving the gas delivery pipes 50, 52 to locations above the selected locations. Actuators (not shown) controlled by controller 58 may be disposed along the casting rolls 12 adapted to adjust the position of the gas delivery pipes 50, 52. In further embodiments the continuous caster 100 may comprise a continuous plurality of gas delivery pipes 50 distributed along part, or all, of the length of the casting rolls 12 within the selected distance of the end portions 13, with the controller 58 adapted to selectively control the shell thickness controlling gas 71 delivered through each gas delivery pipe 50 individually, or in groups of several gas delivery pipes 50, or both.

Figure 8:
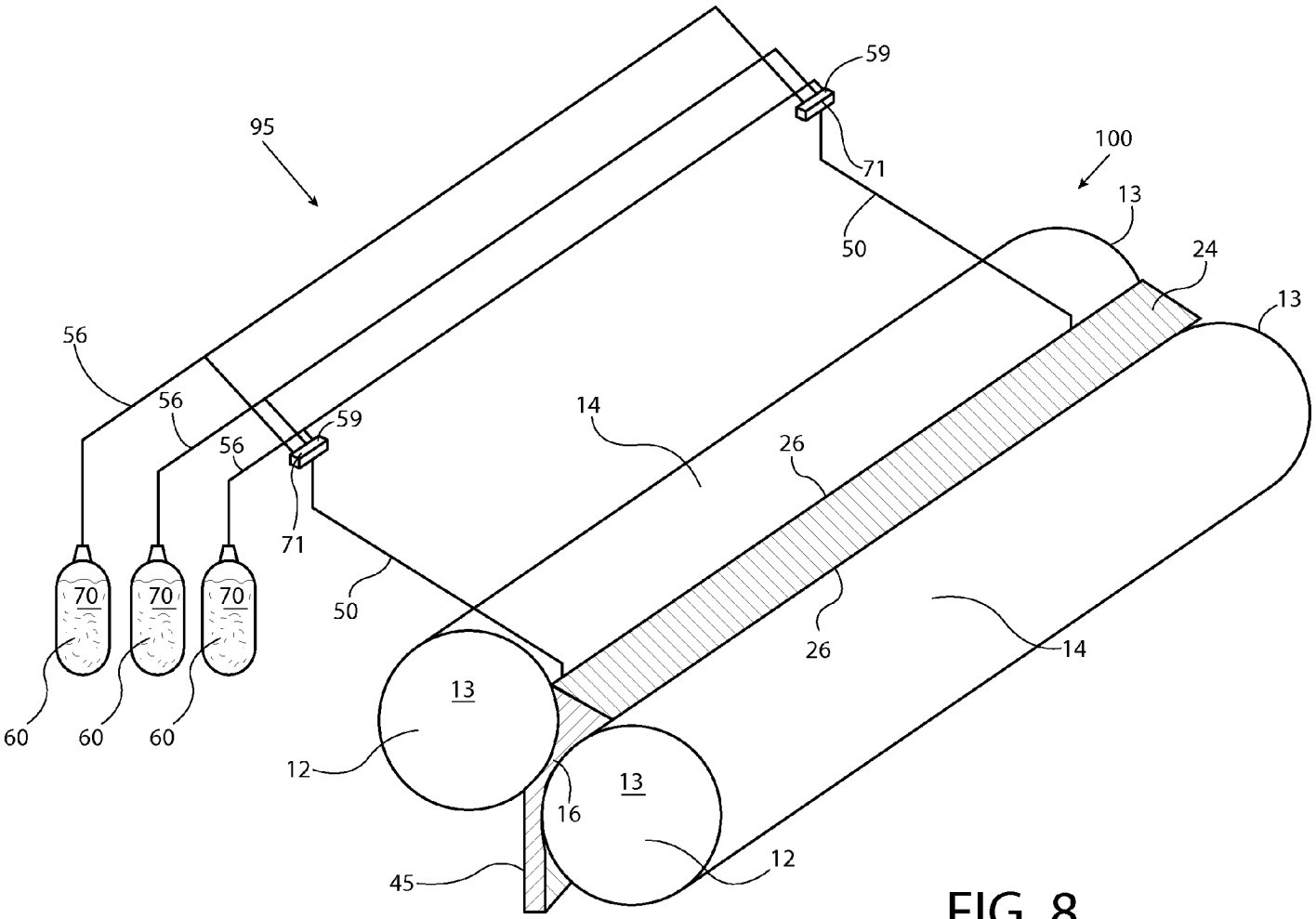
FIG. 8 is an enlarged partial perspective view of another embodiment of the presently disclosed continuous casting apparatus shown in FIG. 6.

The presently disclosed method may alternatively comprise the shell thickness control gas 71 being delivered to the meniscus 26 via delivery pipes at a second position 52 between 35 and 150 mm from the casting roll end portions 13. The continuous casting apparatus 100 may also comprise two edge gas pipes 50 at a first position adjacent the end portions 13 of the casting rolls, adapted to deliver shell thickness controlling gas 71 downwardly toward the meniscus 26. Alternatively, the continuous casting apparatus 100 may comprise a single gas delivery pipe 50 positioned at a first position above the end portions 13 of the casting rolls 12 adapted to deliver shell thickness controlling gas 71 downwardly toward the meniscus 26 (as shown in FIG. 8).

Some embodiments of the presently disclosed method may comprise delivering shell thickness controlling gas 71 to the meniscus 26 adjacent both casting rolls 12. Such methods of continuously casting metal strip performed on the continuous casting apparatus 100 may comprise delivering a shell thickness controlling gas 71 to select areas within 300, 150, 50, or 35 mm of end portions 13 of the pair of casting rolls 12 downwardly toward the meniscus 26 between the casting pool 24 and the casting surface 14 of each casting roll 12 adapted to control thickness of the metal shells forming on the casting rolls 12. The step of delivering the shell thickness control gas 71 may be performed to both casting rolls at the same time. Optionally, such methods may include the step of sensing either or both of the temperature profile 66 and/or thickness profile 68 of the cast strip 45 downstream from the nip 16 to determine high or low temperature areas or thick or thin strip profile thickness areas of the cast strip 45 within 300, 150, 50 or 35 mm of the end portions 13 indicating desired areas where shell thickness controlling gas 71 is to be delivered, and causing the gas 71 to be delivered to such high or low temperature areas, to change the thickness of the metal shell. One or more sensors 62, positioned below the nip 16 may be adapted to measure the strip temperature profile 66 and/or strip thickness profile 68, and adapted to send the measured data information to a controller 58. The controller 58 may be adapted to receive the information from the one or more sensors 62 and determine a desired amount and composition of shell thickness controlling gas 71 to be delivered at each area of the meniscus 26 along each casting roll 12 within a selected distance of the end portions 13.

In any embodiment having two or more gas delivery positions, the shell thickness controlling gas 71 delivered by gas delivery pipes 52 at the second position may be of different composition than the gas 71 delivered through gas delivery pipes 50 at a first position, the composition of both shell thickness controlling gases 71 determined by the controller 58 based on the sensor readings, such as a temperature profile 66 or a thickness profile 68, of the cast strip 45 adjacent the nip 16. The amount and composition of the shell thickness controlling gas 71 determined by the controller 58 and delivered downwardly toward the meniscus 26 near one casting roll end portion 13, is associated with the temperature or thickness profiles, or both, of the cast strip 45 or casting rolls 12 near the end portions 13. Therefore, the shell thickness controlling gas 71 delivered to the gas delivery pipes 50 in a first position within a selected distance of one end portion 13 may be different from the shell thickness controlling gas 71 delivered to the gas delivery pipes 50 within a selected distance of the other end portion 13. Similarly the amount and composition of each shell thickness controlling gas 71 may be different for each gas delivery pipe 50.

Furthermore, at each position along the casting rolls 12 there may be a single gas delivery pipe or multiple gas delivery pipes. Each mixer 59 may be associated with a single delivery pipe 50, or, alternatively, each mixer 59 may be associated with two or more delivery pipes 50.

FIG. 8 illustrates an embodiment somewhat similar to that illustrated in FIGS. 5 and 6, except that the embodiment shown in FIG. 8 has a single gas delivery pipe 50 distributed within 300 mm of the casting roll end portions 13 positioned within 150 mm above the meniscus 26.

FIG. 9 illustrates an embodiment somewhat similar to those illustrated in previous figures and described above, except that the embodiment shown in FIG. 9 comprises a single mixer 57, adapted to receive at least one source gas 70, mix, and deliver shell thickness controlling gas 71 to each gas delivery pipe 50. Furthermore, FIG. 9 comprises gas delivery pipes at multiple locations within selected distances from the casting roll end portions 13. FIG. 9 shows a continuous casting apparatus 100 having a shell thickness controlling gas delivery system 95. The gas delivery system 95 comprises gas delivery pipes 50 at a first position adjacent casting roll end portions 13, gas delivery pipes 52 at a second position, inward of the first position, and gas delivery pipes 54 at a third position, inward of the second position. At each position there may be a single or multiple gas delivery pipes. The gas delivery system 95 also comprises a plurality of shell thickness controlling gas sources 60, each gas source 60 adapted to store a shell thickness controlling source gas 70. Each gas delivery pipe 50, 52, 54, and each gas source 60 are connected to a controller 57 adapted to receive desired amounts of each source gas 70 from the gas sources 60, mix the source gases 70 in the desired quantities and ratios, and deliver the mixed shell thickness controlling gas 71 to each gas delivery pipe 50, 52, 54. The controller 57 may be adapted to deliver a desired mixed shell thickness controlling gas 71 to each individual gas delivery pipe. Alternatively the controller 57 may be adapted to deliver a desired mixed shell thickness controlling gas 71 to all gas delivery pipes simultaneously. Furthermore, each gas delivery pipe 50 may be configured such that it may be selectively positioned and the controller 58 may be adapted to selectively position the gas delivery pipes 50 along and above the localized high or low heat flux regions, for example, by way of an actuator.

In embodiments of the presently disclosed method for continuously casting metal strip, the method may comprise where the gas may be delivered to the meniscus of both casting rolls within a selected distance of 300 mm from the end portions of each casting roll. Each casting roll may comprise an individual gas delivery system 95 adapted to independently deliver shell thickness controlling gas 71 downwardly toward the meniscus 26 at each localized high or low strip temperature area, and/or thick or thin strip profile thickness area, on each casting roll 12. Alternatively, there may be a single gas delivery system 95 adapted to control the quantity and composition of shell thickness controlling gas 71 downwardly toward the meniscus adjacent both casting rolls 12. The gas delivery system 95 may provide a desired quantity and composition of shell thickness reducing gas 71 downwardly toward the meniscus 26 at each selected position on the casting rolls 12, and provide the same desired amount and composition of shell thickness controlling gas 71 at opposing positions on the opposite casting roll 12. Such embodiments may comprise one or more controllers 58. In some embodiments the continuous casting apparatus 100 may comprise one controller 58 adapted to determine a selected amount and composition of each source gas 70 to be delivered to a mixer 59 and deliver a mixed shell thickness controlling gas 71 downwardly toward the meniscus 26 within a selected distance from the casting roll end portions 13 of both casting rolls 12. Alternatively, there may be two or more controllers 58 each controller 58 adapted to determine a selected amount and composition of each source gas 70 to be delivered to a mixer 59, and to deliver shell thickness controlling gas 71 downwardly toward the meniscus 26, through gas delivery pipes 50 to the meniscus adjacent each casting roll 12. Each controller 58 may also be adapted to determine a selected position at the meniscus 26 to which to deliver shell thickness controlling gas 71.

While the invention has been described with reference to certain embodiments it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments falling within the scope of the appended claims.

What is claimed is:

1. A method of continuously casting metal strip comprising:

assembling a pair of counter-rotatable casting rolls having casting surfaces laterally positioned to form a gap at a nip between casting rolls through which thin cast strip can be cast, assembling a metal delivery system adapted to deliver molten metal above the nip to form a casting pool supported on the casting surfaces of the casting rolls and confined at the ends of the casting rolls, the casting pool forming a meniscus with each casting surface of the casting rolls, and counter rotating the casting rolls to form metal shells on the casting surfaces of the casting rolls that are brought together at the nip to deliver cast strip downwardly from the nip, delivering a shell thickness controlling gas to select areas within 300 mm of end portions of at least one casting roll downwardly toward the meniscus between the casting pool and the casting surface of the casting roll selected to control thickness of the metal shell without delivering the shell thickness controlling gas to other areas across the casting roll, and sensing the temperature and thickness profiles of the cast strip downstream from the nip to determine high or low temperature areas of the cast strip within 300 mm of end portions and causing the gas to be delivered to the high or low temperature areas to change the thickness of the metal shell.

2. The method of continuously casting metal strip as claimed in claim 1 where in addition determining high or low temperature areas of the cast strip within 150 mm of the end portions and causing the gas to be delivered to such high or low temperature areas to change the thickness of the metal shell.

3. The method of continuously casting metal strip as claimed in claim 1 where in addition determining high or low temperature areas of the cast strip within 50 mm of the end portions and causing the gas to be delivered to such high or low temperature areas to change the thickness of the metal shell.

4. The method of continuously casting metal strip as claimed in claim 1 where the gas is delivered to the meniscus from a distance less than 150 mm above the casting pool.

5. The method of continuously casting metal strip as claimed in claim 1 where the gas is delivered to the meniscus at a position between 30 mm and 50 mm from the end portions of the casting rolls.

6. The method of continuously casting metal strip as claimed in claim 1 where in addition the gas is delivered to the meniscus at a second position between 50 mm and 300 mm from the end portions of the casting roll.

7. The method of continuously casting metal strip as claimed in claim 1 where in addition the gas is delivered to the meniscus near the end portions of the casting roll.

8. The method of continuously casting metal strip as claimed in claim 1 where in addition the gas is delivered to the meniscus at a first position within 50 mm from the end portions of the casting roll and a second position between 50 mm and 300 mm from the end portions of the casting roll.

9. The method of continuously casting metal strip as claimed in claim 7 where in addition the gas is delivered to the meniscus at a first position within 50 mm from the end portions of the casting roll and a second position between 50 mm and 300 mm from the end portions of the casting roll.

10. The method of continuously casting metal strip as claimed in claim 1 where the gas is delivered to the meniscus of both casting rolls within 300 mm from the end portions of each casting roll.

11. The method of continuously casting metal strip as claimed in claim 10 where in addition determining the high or low temperature areas of the cast strip within 150 mm of the end portions and causing the gas to be delivered to such the high or low temperature areas to change the thickness of the metal shell.

12. The method of continuously casting metal strip as claimed in claim 10 where in addition determining such high or low temperature areas of the cast strip within 50 mm of the end portions and causing the gas to be delivered to such the high or low temperature areas to change the thickness of the metal shell.

13. The method of continuously casting metal strip as claimed in claim 10 where the gas is delivered to the meniscus from a distance lower than 150 mm above the casting pool.

14. The method of continuously casting metal strip as claimed in claim 10 where the gas is delivered to the meniscus at a position between 30 mm and 50 mm from the end portions of the casting rolls.

15. The method of continuously casting metal strip as claimed in claim 10 where in addition the gas is delivered to the meniscus at a second position between 50 mm and 300 mm from the end portions of the casting roll.

16. The method of continuously casting metal strip as claimed in claim 10 where in addition the gas is delivered to each meniscus near the end portions of each casting roll.

17. The method of continuously casting metal strip as claimed in claim 10 where in addition the gas is delivered to each meniscus at a first position within 50 mm from the end portions of the casting roll and a second position between 50 mm and 300 mm from the end portions of each casting roll.

18. The method of continuously casting metal strip as claimed in claim 16 where in addition the gas is delivered to each meniscus at a first position within 50 mm from the end portions of the casting roll and a second position between 50 mm and 300 mm from the end portions of each casting roll.

19. The method of continuously casting metal strip as claimed in claim 1 where the shell thickness controlling gas is selected from the group consisting of argon, carbon dioxide, hydrogen, helium, nitrogen, air, dry air, water vapor, carbon monoxide and mixtures of at least two thereof.

20. The method of continuously casting metal strip as claimed in claim 1 further comprising the step of assembling a carbon seal laterally positioned above each casting roll to restrict oxygen from entering the chamber.

21. A method of continuously casting metal strip comprising:

assembling a pair of counter-rotatable casting rolls having casting surfaces laterally positioned to form a gap at a nip between casting rolls through which thin cast strip can be cast, assembling a metal delivery system adapted to deliver molten metal above the nip to form a casting pool supported on the casting surfaces of the casting rolls and confined at the ends of the casting rolls and counter rotating the casting rolls to form metal shells on the casting surfaces of the casting rolls that are brought together at the nip to deliver cast strip downwardly from the nip, the casting pool forming a meniscus with each casting surface of the casting rolls, and;

delivering a shell thickness controlling gas to select areas within 300 mm of end portions of at least one casting roll downwardly toward the meniscus between the casting pool and the casting surface of the casting roll adapted to control thickness of the metal shell without delivering the shell thickness controlling gas to other areas across the casting roll.

22. The method of continuously casting metal strip as claimed in claim 21 where the gas is delivered to the meniscus from a distance lower than 150 mm above the casting pool.

23. The method of continuously casting metal strip as claimed in claim 21 where the gas is delivered to the meniscus at a position between 30 mm and 50 mm from the end portions of the casting roll.

24. The method of continuously casting metal strip as claimed in claim 21 where in addition the gas is delivered to the meniscus at a second position between 50 mm and 300 mm from the end portions of the casting roll.

25. The method of continuously casting metal strip as claimed in claim 21 where in addition the gas is delivered to the meniscus near the end portions of each casting roll.

26. The method of continuously casting metal strip as claimed in claim 21 where in addition the gas is delivered to the meniscus at a first position within 50 mm from the end portions of the casting roll and a second position between 50 mm and 300 mm from the end portions of each casting roll.

27. The method of continuously casting metal strip as claimed in claim 25 where in addition the gas is delivered to the meniscus at a first position within 50 mm from the end portions of the casting roll and a second position between 50 mm and 300 mm from the end portions of each casting roll.

28. The method of continuously casting metal strip as claimed in claim 21 where at positions of high or low temperature areas of the cast strip within 150 mm of the end portions causing the gas to be delivered to such the high or low temperature areas to change the thickness of the metal shell.

29. The method of continuously casting metal strip as claimed in claim 21 where at positions of high or low temperature areas of the cast strip within 50 mm of the end portions causing the gas to be delivered to such the high or low temperature areas to change the thickness of the metal shell.

30. The method of continuously casting metal strip as claimed in claim 21 where the gas is delivered to the meniscus of both casting rolls within 300 mm from the end portions of each casting roll.

31. The method of continuously casting metal strip as claimed in claim 30 where the gas is delivered to each meniscus from a distance lower than 150 mm above the casting pool.

32. The method of continuously casting metal strip as claimed in claim 30 where the gas is delivered to the meniscus at a position between 30 mm and 50 mm from the end portions of the casting roll.

33. The method of continuously casting metal strip as claimed in claim 30 where in addition the gas is delivered to the meniscus at a second position between 50 mm and 300 mm from the end of the casting roll.

34. The method of continuously casting metal strip as claimed in claim 30 where at positions of high or low temperature areas of the cast strip within 150 mm of the end portions causing the gas to be delivered to such the high or low temperature areas to change the thickness of the metal shell.

35. The method of continuously casting metal strip as claimed in claim 30 where at positions of high or low temperature areas of the cast strip within 50 mm of the end portions causing the gas to be delivered to such the high or low temperature areas to change the thickness of the metal shell.

36. The method of continuously casting metal strip as claimed in claim 30 where in addition the gas is delivered to each meniscus near the end portions of each casting roll.

37. The method of continuously casting metal strip as claimed in claim 30 where in addition the gas is delivered to each meniscus at a first position within 50 mm from the end portions of the casting roll and a second position between 50 mm and 300 mm from the end portions of each casting roll.

38. The method of continuously casting metal strip as claimed in claim 36 where in addition the gas is delivered to each meniscus at a first position within 50 mm from the end portions of the casting roll and a second position between 50 mm and 300 mm from the end portions of each casting roll.

39. The method of continuously casting metal strip as claimed in claim 21 where the shell thickness controlling gas is selected from the group consisting of argon, carbon dioxide, hydrogen, helium, nitrogen, air, dry air, water vapor, carbon monoxide and mixtures of at least two thereof.

40. The method of continuously casting metal strip as claimed in claim 21 further comprising the step of assembling a carbon seal laterally positioned above each casting roll to restrict oxygen from entering the chamber.

* * * * *